US011993450B2

(12) United States Patent
Talon

(10) Patent No.: US 11,993,450 B2
(45) Date of Patent: May 28, 2024

(54) SEMI-RIGID SACHET FOR BEVERAGE PREPARATION

(71) Applicant: SOCIETE DES PRODUITS NESTLE S.A., Vevey (CH)

(72) Inventor: Christian Talon, Vufflens-le-Chateau (CH)

(73) Assignee: Societe des Produits Nestle S.A., Vevey (CH)

( * ) Notice: Subject to any disclaimer, the term of this patent is extended or adjusted under 35 U.S.C. 154(b) by 0 days.

(21) Appl. No.: 17/291,498

(22) PCT Filed: Nov. 8, 2019

(86) PCT No.: PCT/EP2019/080631
§ 371 (c)(1),
(2) Date: May 5, 2021

(87) PCT Pub. No.: WO2020/094822
PCT Pub. Date: May 14, 2020

(65) Prior Publication Data

US 2022/0002074 A1 Jan. 6, 2022

(30) Foreign Application Priority Data

Nov. 8, 2018 (EP) ..... 18205141

(51) Int. Cl.
*B65D 85/804* (2006.01)

(52) U.S. Cl.
CPC ..... *B65D 85/8052* (2020.05); *B65D 85/8049* (2020.05)

(58) Field of Classification Search
CPC ..... B65D 85/8043; B65D 85/8048; B65D 85/8052
See application file for complete search history.

(56) References Cited

U.S. PATENT DOCUMENTS 3,915,296 A 10/1975 Spencer
6,644,173 B2 11/2003 Lazaris et al.

FOREIGN PATENT DOCUMENTS

CN 102985339 A 3/2013
CN 104995108 A 10/2015
CN 106535720 A 3/2017
EP 0272922 6/1988
EP 1042978 A1 10/2000
(Continued)

OTHER PUBLICATIONS

Chinese Office Action for Appl No. 201980085008.3 dated Aug. 2, 2022.

(Continued)

*Primary Examiner* — Viren A Thakur
*Assistant Examiner* — Chaim A Smith
(74) *Attorney, Agent, or Firm* — K&L Gates LLP

(57) ABSTRACT

A pack (1) with an inner volume in which a food or beverage ingredient is stored and in which a beverage is produced when water is introduced inside. The pack (1) comprises at least one inlet configured to supply water in the inner volume of the pack (1) and one outlet (11) for dispensing a beverage from the inner volume of the pack (1). The pack (1) comprises a semi-rigid or rigid shell (2), the shell (2) comprises a main plane wall (20) surrounded by a peripheral edge (21), and a cover part (3) sealed on the peripheral edge (21), the shell (2) and the cover part (3) defining therebetween said inner volume.

14 Claims, 6 Drawing Sheets

(56) References Cited

FOREIGN PATENT DOCUMENTS

| | | | |
|---|---|---|---|
| JP | H029361 | A | 1/1990 |
| JP | 2017524395 | A1 | 8/2017 |
| WO | 0158786 | | 8/2001 |
| WO | 2017003291 | | 1/2017 |

OTHER PUBLICATIONS

India Office Action for Appl No. 202117019846 dated Oct. 12, 2022.

SEMI-RIGID SACHET FOR BEVERAGE PREPARATION

CROSS REFERENCE TO RELATED APPLICATIONS

The present application is a National Stage of International Application No. PCT/EP2019/080631, filed on Nov. 8, 2019, which claims priority to European Patent Application No. 18205141.7, filed on Nov. 8, 2018, the entire contents of which are being incorporated herein by reference.

FIELD OF THE INVENTION

The present invention concerns a pack comprising a food or beverage ingredient for the preparation of beverages.

BACKGROUND OF THE INVENTION

It is known to prepare beverages by using a pack containing a beverage making ingredient, such as extractible ingredient (for example ground coffee), or water-soluble ingredient (for instance instant coffee, milk powder or chocolate powder).

The pack has an inner volume in which a food or beverage ingredient is stored and in which a beverage is produced when water is introduced inside.

To improve the circulation of water in the pack and the mixture of the food or beverage ingredient with the water, it is preferable that the pack presents a generally plane shape. Preferably the plane shape is essentially vertically oriented during beverage production, when the pack is inserted in a dispensing machine.

The pack comprises one outlet for dispensing the beverage from the inner volume of the pack to a receptacle. The outlet is preferably configured so that it delivers the beverage as a free flow. The beverage can flow from the outlet by simple gravity fall.

Such a pack is described for instance in WO 2016 023726. In this document, the pack is a flexible sachet. The sachet is made out of a flexible film material.

The sachet is used in a beverage dispensing machine and water is injected into the sachet, for example thanks to an injection needle. The beverage making ingredient is extracted or dissolved into water to form the beverage. The beverage flows out of the sachet through a suitable outlet, at the bottom of the sachet.

In this type of flexible sachet, a spout is introduced at the bottom of the sachet and the beverage is evacuated by the spout.

These flexible sachets present drawbacks. One of them is that it gives a lot variability of reconstitution parameters due to the fact that each sachet behaves differently. Thus the formation of foam and the dissolution of the powder are not reproducible and are hardly controllable.

Besides there can be a risk that the sachet opens up in an uncontrollable explosion due to an increase of pressure inside the sachet during water injection. For this reason, the dispensing machine generally has to comprise means for totally enclosing the sachet in the machine during beverage preparation and avoid damages or injuries for the operator.

The object of the present invention is to propose a pack for the preparation of a food or beverage that solves at least partly the above drawbacks, improves the manufacturing of the pack and makes the beverage preparation easier.

SUMMARY OF THE INVENTION

The invention concerns a pack with an inner volume in which a food or beverage ingredient is stored and in which a beverage is produced when water is introduced inside, said pack comprising at least one inlet configured to supply water in the inner volume of the pack and one outlet for dispensing a beverage from the inner volume of the pack.

According to the invention, the pack comprises a semi-rigid or rigid shell, said shell comprising a main plane wall surrounded by a peripheral edge, and a cover part sealed on said peripheral edge, said shell and said cover part defining therebetween said inner volume.

The pack thus provided, with a rigid or semi-rigid shell, reduces the variability of the reconstitution parameters of the beverage. In particular, the circulation of water introduced inside the pack may be kept in a plane parallel to the main plane wall of the shell, improving the dissolution and the mixture of the ingredient with water. The formation of foam in the beverage, notably for coffee and chocolate beverage, may be more predictable, mainly depending on the volume, pressure and rate of the water introduced inside the pack.

Such a pack with a rigid or semi-rigid shell is moreover compact and easier to handle by the user.

According to one embodiment, said one outlet is formed by an opening in the shell.

Thanks to the semi-rigid or rigid material used for the shell, the outlet of the pack may be formed in the shell, avoiding the need of an additional component in the pack, such as a spout used in the prior art.

Advantageously, said one outlet is formed in the peripheral edge of the shell.

In one embodiment, the peripheral edge has an opening, defined by an interruption of said peripheral edge of the shell, two portions of said peripheral edge extending face each other on each side of said opening and forming said one outlet of said pack.

The outlet is thus directly formed by some portions of the peripheral edge of the edges. The portions extending face each other define a tube or a passage for guiding the beverage outside the pack.

When the outlet is provided at the bottom of the pack when said pack is used in a beverage preparation machine for the production of a beverage, there is no need to implement a particular connection between the outlet and the beverage machine when a beverage is produced e.g. for directing the flow of beverage delivered at the outlet. The beverage can flow from the pack outlet directly in a drinking cup.

In practice, an openable tab closes said one outlet, said openable tab extending from said cover part of the pack.

Thanks to the tab, the closure of the outlet guarantees hygienic and shelf life protection. The outlet can be opened manually or by specific means of the beverage preparation machine.

In one embodiment, said at least one inlet is provided in the main plane wall of the shell with a piercing area configured to be pierced by a water injection needle of a machine for preparing beverages.

Water may be injected inside the pack directly by an injection needle piercing the main plane wall of the shell.

In one embodiment, the main plane wall has an outer face and an inner face, one rib protruding from said inner face of the main wall and partly surrounding an injection area configured to receive a water injection needle of a machine for preparing beverages.

The end of the injection needle is thus protected by the rib partly surrounding the injection area, in the inner volume of the pack, during the injection of water and the preparation of the beverage. The entering water flow is not disturbed by the circulation of the water flow inside the pack and the mixing movement of the water and the food or beverage ingredient.

Advantageously, when said pack is used in a beverage preparation machine for the production of a beverage, said one rib partly surrounding said injection area is interrupted in a portion adapted to be disposed face to the top of the pack, and said one outlet is provided at the bottom of the pack.

Thus, the water is projected towards the top of the pack, away from the outlet. The mixing movement of the water and the food or beverage ingredient is thus improved before that the beverage is dispensed from the pack.

In practice, said one rib projects from the inner face of the main wall of the shell towards the cover part of the pack.

Said one rib has a height from said inner face of the main wall substantially equal to a height of the peripheral edge of the shell.

Thus the rib may be substantially in contact with or close to an inner face of the cover part of the pack and an additional piercing area may be provided in the cover part. The additional piercing area is partly surrounded by the rib projecting on the inner face of the main wall of the shell.

As a consequence, water may be injected in the inner volume of the pack by an injection needle, passing through the cover part of the pack.

In one advantageous embodiment, said main plane wall of the shell comprises two ribs protruding from said inner face of the main plane wall and surrounding respectively partly two injection areas, said two injection areas being symmetrically disposed in said main plane wall of the shell with respect to said one outlet.

This embodiment renders the pack symmetric; then the consumer can indifferently introduce it in one way or another inside the corresponding beverage preparation machine.

Depending on the way of introduction of the pack in the machine, the water may be injected through the shell or through the cover part of the pack.

In a practical way, the shell is formed by a thermoforming process or a plastic injection process, said at least one inlet and said one outlet of the pack being co-formed with the shell.

The manufacturing of the pack with the inlet for water and the outlet for beverage is made easier.

The shell is made of one unique rigid or semi-rigid material chosen amongst plastic, thick paper or cardboard.

In practice, the peripheral edge of the shell comprises a wing extending substantially perpendicularly to the peripheral edge, the cover part being sealed on the wing.

The cover part is a flexible membrane or a rigid or semi-rigid wall.

BRIEF DESCRIPTION OF THE DRAWINGS

Additional features and advantages of the present invention are described in, and will be apparent from, the description of the presently preferred embodiments which are set out below with reference to the drawings in which.

DETAILED DESCRIPTION OF THE INVENTION

In the present application the terms "bottom", "top", "lateral", "horizontal" and "vertical" are used to describe the relational positioning of features of the invention. These terms should be understood to refer to the pack in its normal orientation when introduced in a beverage preparation machine for the production of a beverage as shown for example in FIG. 6.

Likewise, the terms "width" and "height" are used to describe the dimensions of the invention. "Width" shall mean in the described embodiment the horizontal dimension and "height" shall mean the dimension along a transverse direction perpendicular to the horizontal and vertical directions.

Figure 1:
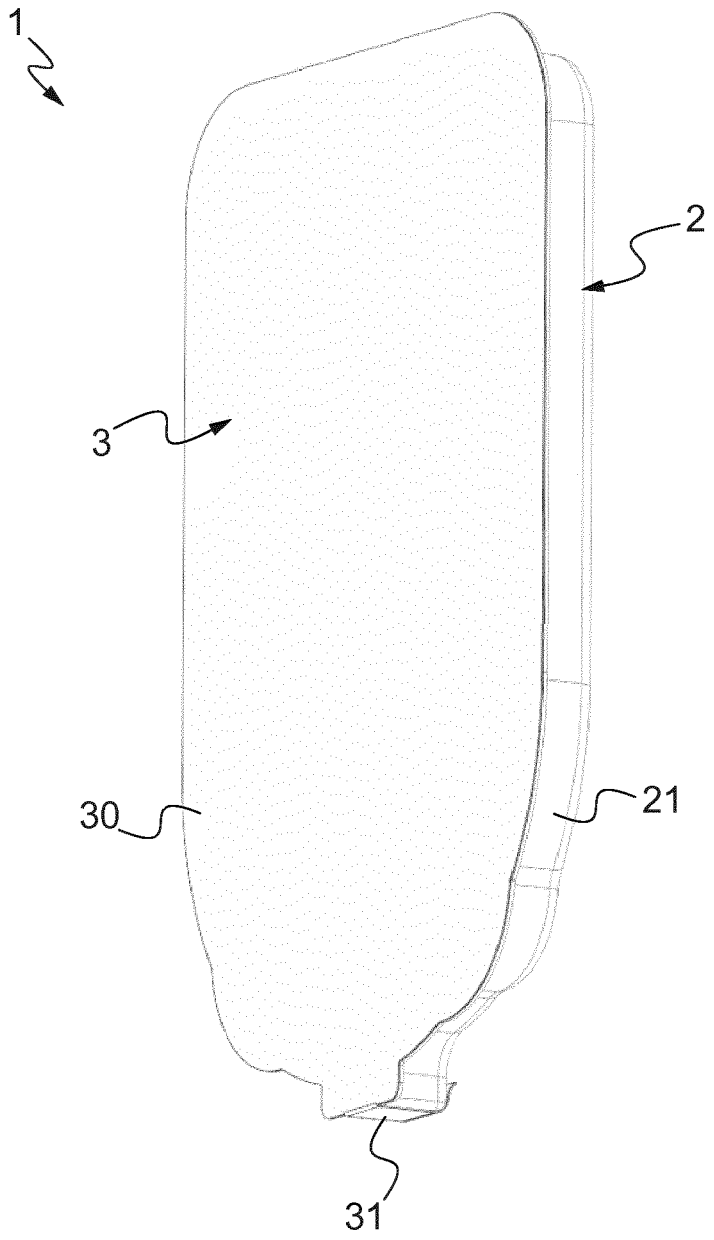
FIG. 1 illustrates a pack according to one embodiment of the present invention.
Figure 2A:
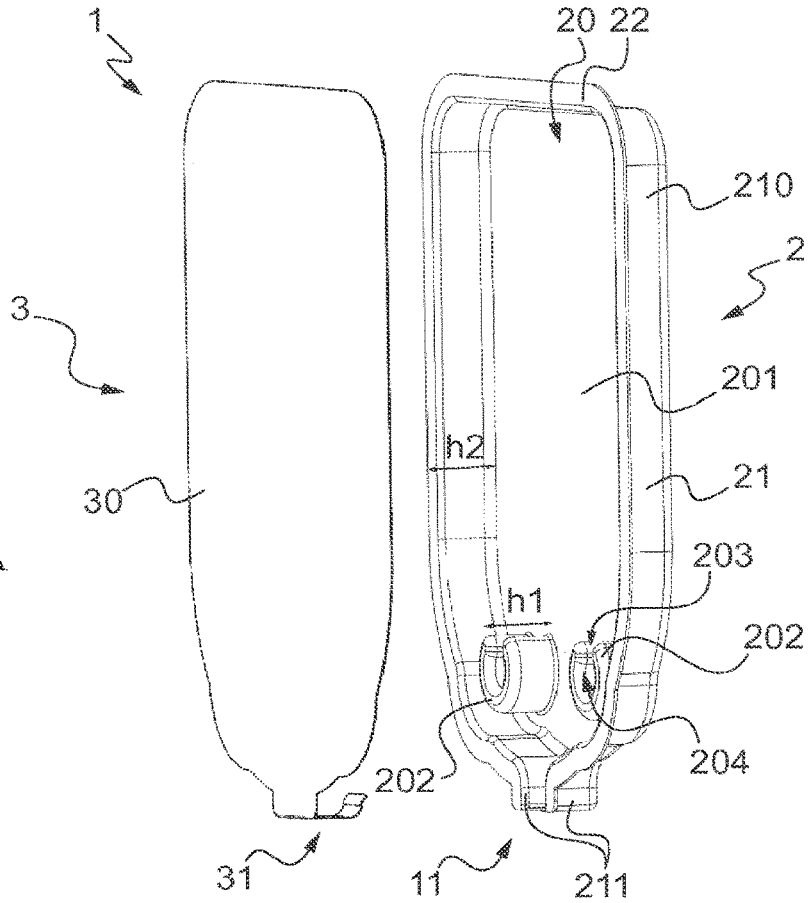
FIGS. 2A, 2B illustrate exploded views of the pack of FIG. 1.
Figure 2B:
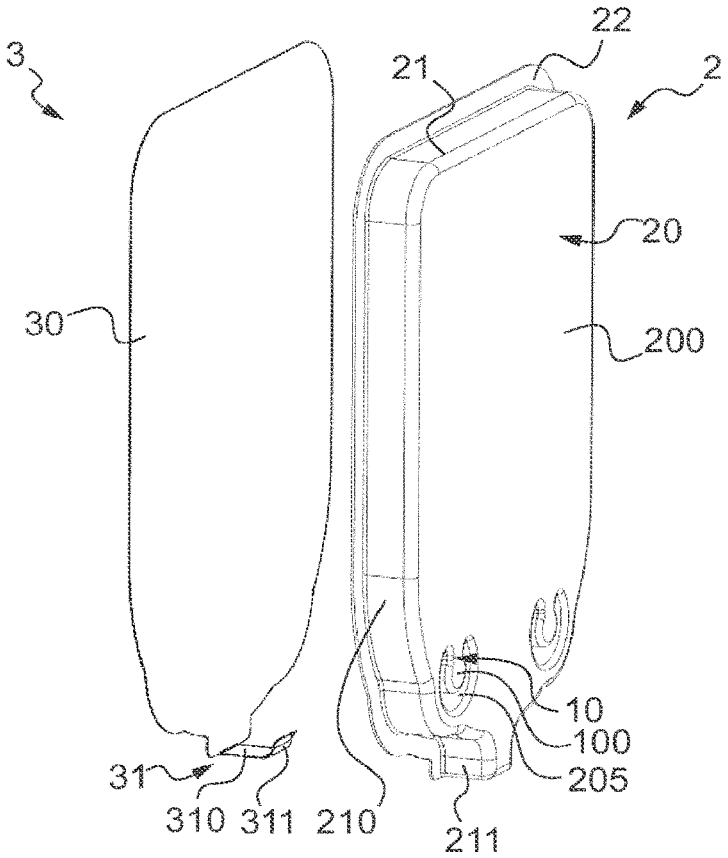

FIG. 1 illustrates a pack 1 for producing a beverage according to one embodiment of the invention. FIGS. 2*a*, 2*b* are exploded views of the pack of FIG. 1. The pack 1 may also be referred to as "sachet" or "pouch".

In the illustrated embodiment, the pack 1 presents a rectangular shape. The pack 1 comprises a shell 2 and a cover part 3. The cover part 3 covers the shell 2 so that the pack 1 is perfectly closed. The shell 2 and the cover part 3 form an inner volume in which a food or beverage ingredient (not illustrated in the figures) is stored.

The food or beverage ingredient of the pack can be comprised within the list of: soups, fruit juices, vegetable juices, bouillons, coffee, chocolate, tea, milk or creamer, or a combination thereof. The food or beverage ingredient is preferably a soluble food or beverage ingredient. Preferably the food or beverage ingredient is a soluble food or beverage ingredient selected in the list of:

- instant coffee powder, milk powder, cream powder, instant tea powder, cocoa powder, soup powder, chocolate powder or mixture of said powders,
- a coffee concentrate, a milk concentrate, a syrup.

The powders can be agglomerated or sintered. The powders or liquid concentrates can be mixed with small solid pieces for example for preparing soups with solid pieces.

The pack 1 comprises at least one inlet 10 which enables a liquid to enter the pack 1 and one outlet 11 to enable the beverage formed by the mixture of the liquid with the food or beverage ingredient to flow out of the pack 1. The liquid which is usually supplied in the inner volume of the pack is water. For this reason, the liquid may be referred to in this document as "water". But of course, the liquid can be of any other type, for example milk.

The shell 2 comprises a plane wall 20 surrounded by a peripheral edge 21. The shell 2 has substantially a rectangular outline with inside corners presenting a rounded wedge shape. Rectangular outline of the shell shall be understood here as the plane wall having a rectangular shape.

The plane wall 20 has an outer face 200 and an inner face 201. The inner face 201 is the face in contact with the beverage ingredient. In the illustrated embodiment, the width of the plane wall 20 narrows at the bottom of the pack 1.

In the described embodiment, the inlet 10 is provided by a piercing area 100 at the plane wall 20. The piercing area 100 is located at the outer face 200 of the plane wall 20. The piercing area 100 is configured to be pierced by a hollow needle 40 for injecting water. The inlet 10 is opened once the piercing area 100 is pierced.

The plane wall 20 also comprises at least one rib 202. The rib 202 protrudes from the inner face 201 of the plane wall 20. The rib 202 extends perpendicularly to the plane wall 20 and towards the cover part 3. The rib 202 has a height h1 represented in FIG. 2*a*.

In the illustrated embodiment, the rib 202 has an Ω-shape. In other words, the rib 202 has a shape of a ring interrupted in a portion forming an aperture 203. The aperture 203 is disposed face to the top of the pack 1.

In the represented embodiment, the rib 202 is part of the shell 2 in the sense that the plane wall 20 and the rib 202 form a single part. The rib 202 forms an Ω-shape recess 205 at the outer face 200 of the plane wall 20.

In another embodiment, the rib 202 can be an insert piece.

The rib 202 partly surrounds an injection area 204. The injection area 204 has in this embodiment a circular outline. In the described embodiment, the rib 202 and thus the injection area 204 are disposed at the bottom of the pack 1 and above the outlet 11.

The peripheral edge 21 extends substantially perpendicularly to the plane wall 20. The peripheral edge 21 has a height h2. The height h1 of the rib 202 and the height h2 of the peripheral edge 21 are substantially equal.

The peripheral edge 21 comprises a wing 22. The wing 22 extends substantially perpendicularly to the peripheral edge 21. In other words, the wing 22 extends substantially parallel to the plane wall 20.

The peripheral edge 21 has two lateral sides 210 facing each other. The lateral sides 210 extend vertically. As the peripheral edge 21 surrounds the plane wall 20, the distance between the lateral sides 210 also narrows at the bottom of the pack 1. Two portions 211 of the lateral sides 210 extending at the bottom of the peripheral edge 21 form a tip.

The peripheral edge 21 has an opening 212 defined by an interruption of the peripheral edge 21. The opening 212 constitutes the outlet of the pack 1. The outlet 11 is formed at the bottom of the pack 1. In the described embodiment, the outlet 11 is formed at the end of the tip. The tip thus forms a passage enabling the beverage to flow out of the pack 1 through the opening 212. As the outlet 11 is positioned at the bottom of the pack 1, the beverage is delivered as a free flow. In other words, the beverage flows out of the pack 1 by simple gravity fall.

The opening 212 has a transverse section with a surface area equivalent to the surface of a circular surface of diameter of at least 1 mm, preferably at most 4 mm, even more preferably comprised between 1.5 and 3 mm.

The shell 2 is semi-rigid or rigid. For example, the shell can be made of plastic, thick paper, cardboard or metallised foil. The plastic material can be selected in the list of: polypropylene, polyethylene, polyethylene terephthalate and polylactic acid. The shell 2 can be monolayer or multilayer (multi-component laminates). For a multilayer shell, different materials can be combined for example from the aforementioned ones. The shell 2 can be formed by a thermoforming process or a plastic injection process.

The cover part 3 is sealed on the shell 2. In the described embodiment, the cover part 3 is sealed on the wing 22. The cover part 3 fits closely the shell 2 so that a perfect sealing of the pack 1 is ensured. The bonding of the shell 2 and the cover part 3 can be obtained by heat sealing.

The cover part 3 comprises a flat part 30 and an openable tab 31.

The flat part 30 extends parallel to the plane wall 20 and fits closely the wing 22. In the described embodiment, the flat part 30 has a rectangular shape with narrowing sides at the bottom.

The openable tab 31 is configured to close the opening 212 formed in the shell 2. The openable tab 31 has a rectangular shape. The openable tab 31 comprises a first part 310 and second part 311.

Figure 3A:
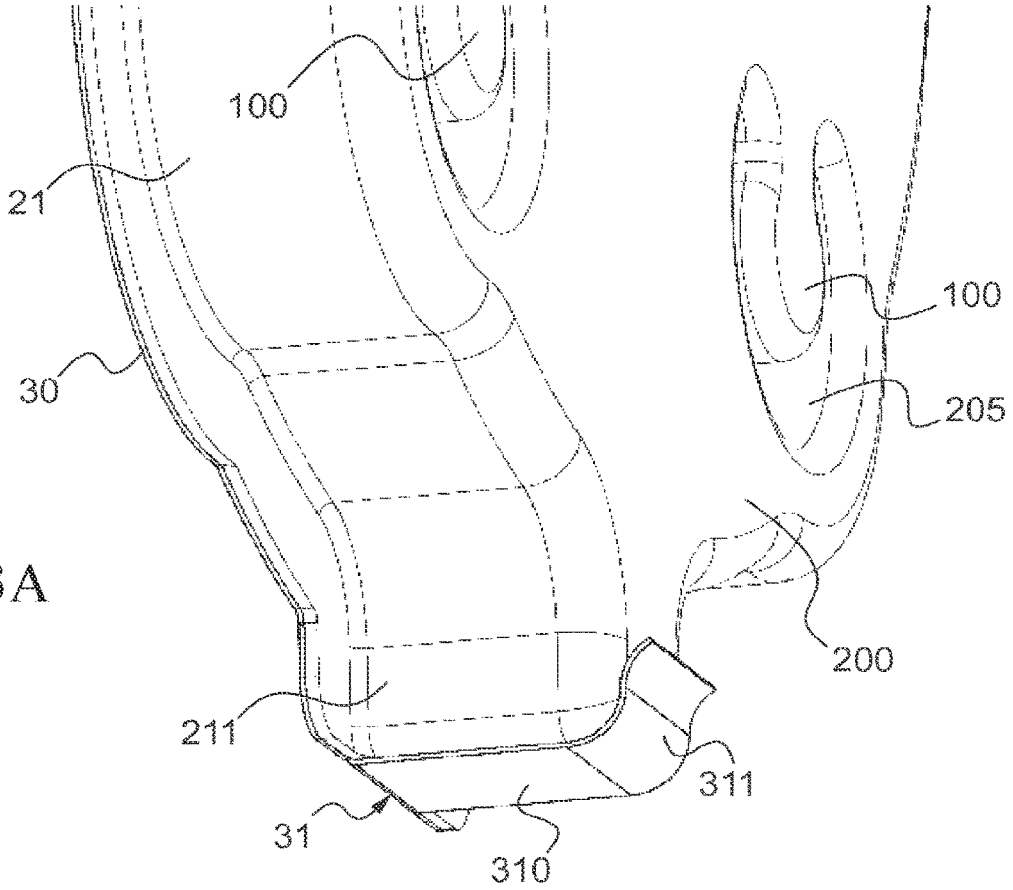
FIGS. 3A, 3B are detail views of the bottom of the pack respectively in an open and a closed configurations.

When the outlet 11 of the pack 1 is closed, as in FIG. 3*a*, the first part 310 of the openable tab 31 extends parallel to the opening 212 and perpendicularly to the flat part 30 of the cover part 3. The first part 310 is sealed on the outlet 11. The first part 310 is configured to close the outlet 11. The second part 311 extends perpendicularly to the first part 310. The second part 311 is disposed against the outer face 200 of the plane wall 20. The second part 311 is configured to maintain the openable tab 31 in a closing configuration of the pack 1.

Generally, the outlet 11 is closed by manufacturing and is configured to be opened at beverage production. By "closed by manufacturing" it is meant that the pack 1 is manufactured with a closed outlet. This closure guarantees hygienic and shelf life protection.

Figure 3B:
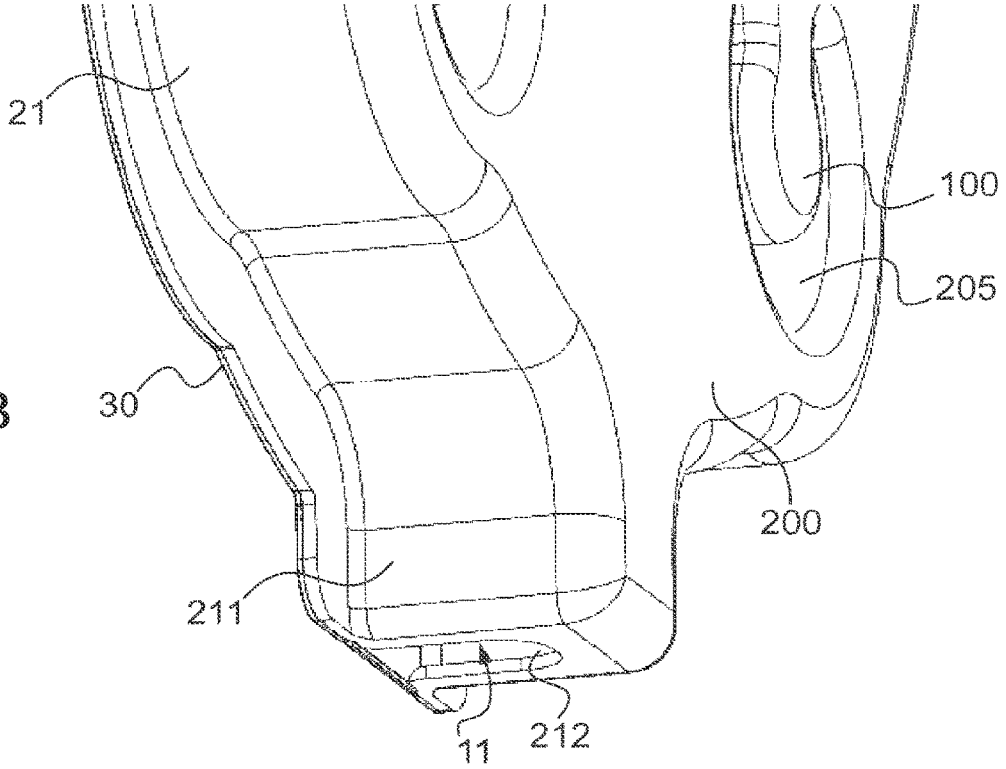

When the pack 1 is in an open configuration, as in FIG. 3*b*, the openable tab 31 part no longer closes the opening 212. The openable tab 31 may be taken off manually by an operator, or automatically by a machine (tearable tab or frangible tab) in order to free the opening 212. The cover part 3 can have pre-cutting lines between the flat part 30 and the openable tab 31 to enable the separation of the openable tab 31 from the flat part 30 and thus the opening 212 of the outlet 11. The openable tab 31 may be taken off entirely, i.e. the first and the second parts, or only the first part 310 can be torn or taken off.

In the described embodiment, the openable tab extends from the cover part. Of course, in another embodiment the cover part and the tab may be two separate elements.

The cover part 3 can be a flexible membrane, a semi-rigid or a rigid wall. Preferably, the cover part is made of the same material as the shell.

Figure 4A:
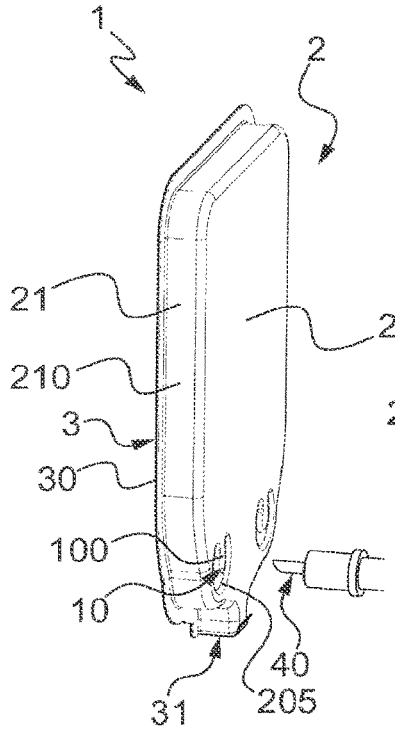
FIGS. 4A, 4B, 4C illustrates the piercing at a shell of the pack by means of a needle.
Figure 4B:
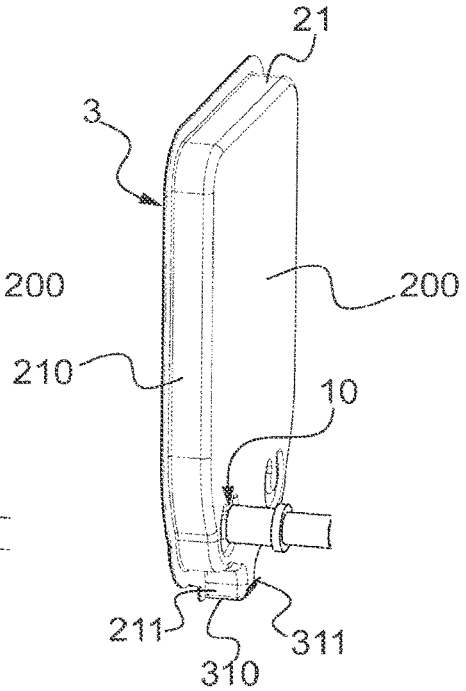
Figure 4C:
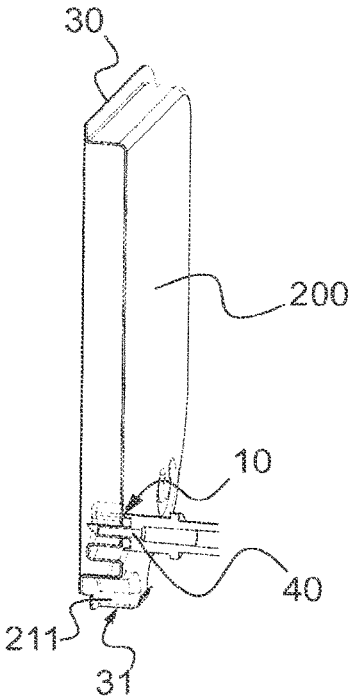

To prepare a beverage, the liquid should be injected into the pack 1. As shown in FIG. 4, the liquid is injected thanks to a needle 40. The needle 40 is configured to pierce the pack 1.

The needle 40 is hollow and enables the passage of the liquid. The needle 40 has a tubular shape with a bevelled end to facilitate the piercing.

In the embodiment represented in FIG. 4, the needle 40 pierces the pack 1 at the shell 2. The needle 40 pierces the outer face 200 of the plane wall at the piercing area 100. The piercing area 100 is located at the area surrounded by the recess 205 formed by the rib 202. Thus, once the pack 1 is pierced, the needle 40 is introduced in the pack 1 and the end of the needle 40 is surrounded by the rib 202. In other words, the end of the needle 40 is in the injection area 204.

The formation of the rib 202 stiffens the pack and thus enables a good piercing of the pack without deformation or deterioration of the pack.

The rib 202 protects the end of the needle 40. In particular, the needle 40 is not in contact with the food or beverage ingredient and with the beverage. This prevents the food or beverage ingredient from sticking on the needle 40.

Figure 5:
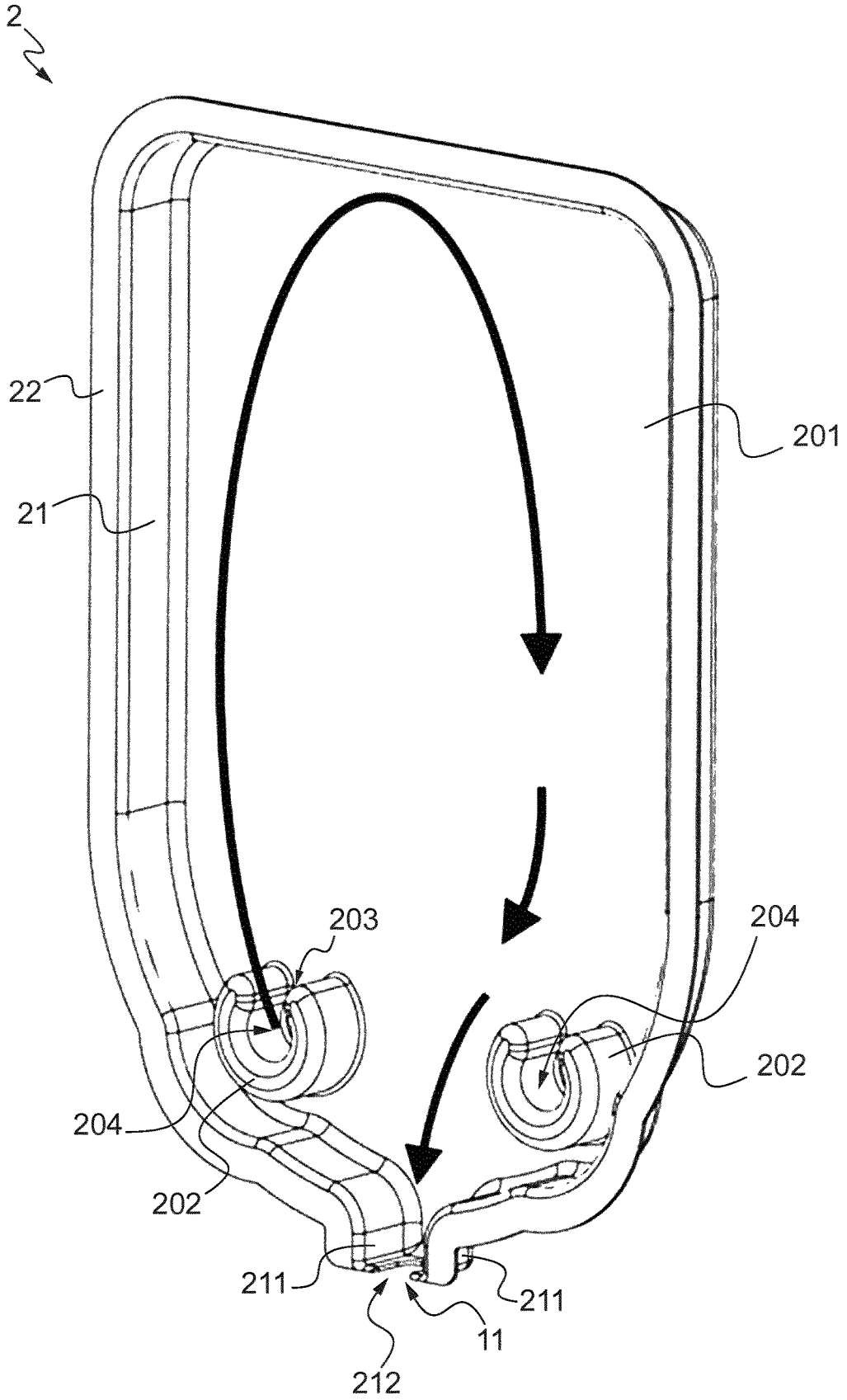
FIG. 5 illustrates the liquid movement in the pack.

FIG. 5 shows the movement of the liquid once injected in the pack 1. When injected through the needle 40, the liquid projects out of the rib 202 disposed around the injection area 204. The liquid exits from the aperture 203 formed in the rib 202.

The formation of the aperture 203 facing the top of the pack 1 enables to direct the liquid towards the top of the pack 1. The liquid is projected away from the outlet 11 of the pack 1 formed at the bottom. This enables a better mixing of the liquid with the food or beverage ingredient. Indeed, the water jet introduced from the bottom into the pack is developing into circular and spiral movements creating turbulences, frictions and high contact surfaces between the water molecules and the product particles. In average the water molecules have several turns within the sachet until they leave the sachet with the beverage. The swirling motion of liquid improves the dilution of the food or beverage ingredient in the liquid.

In the described embodiment, the inner volume of the pack 1 presents a shape configured to improve the movement of the water and the beverage in the pack 1 during beverage preparation. Indeed, the rounded corners of the shell 2 also enable a better mixture of the liquid with the food or beverage ingredient. Indeed, this feature avoids that beverage or food ingredient remains blocked in a right-angled corner.

Moreover, the flatness of the plane wall helps guiding the liquid movement in the pack 1. The food or beverage ingredient is mixed with the liquid in a plane, avoiding thus the stagnation of the food or beverage ingredient.

Once the liquid and the food or beverage ingredient mixed together, the beverage flows out of the pack 1 through the outlet 11. The beverage can thus be dispensed for the operator or user.

In brief, a method for the preparation of a beverage from the pack comprises the steps of:

- providing a pack such as described hereabove and positioning said pack in a preparation machine,
- injecting water into the pack to mix with the food or beverage ingredient,
- allowing the prepared beverage to escape through the outlet into a receptacle.

Preferably the method is implemented by a beverage preparation machine in which the different steps are implemented.

Preferably the inlet 10 is opened at the same time or after the opening of the outlet 11. According to a preferred embodiment, the beverage is prepared with both inlet 10 and outlet 11 being opened. In this way, the beverage is not prepared in the pack under pressure or under pressure increase. According to another embodiment, the outlet may be covered by a filtering material. The filtering material allows the beverage to flow out of the pack but prevents the food or beverage ingredient to go out of the pack before its dissolution in the liquid. The filtering material may be disposed under the openable tab or the openable tab can be made of said filtering material.

Figure 6:
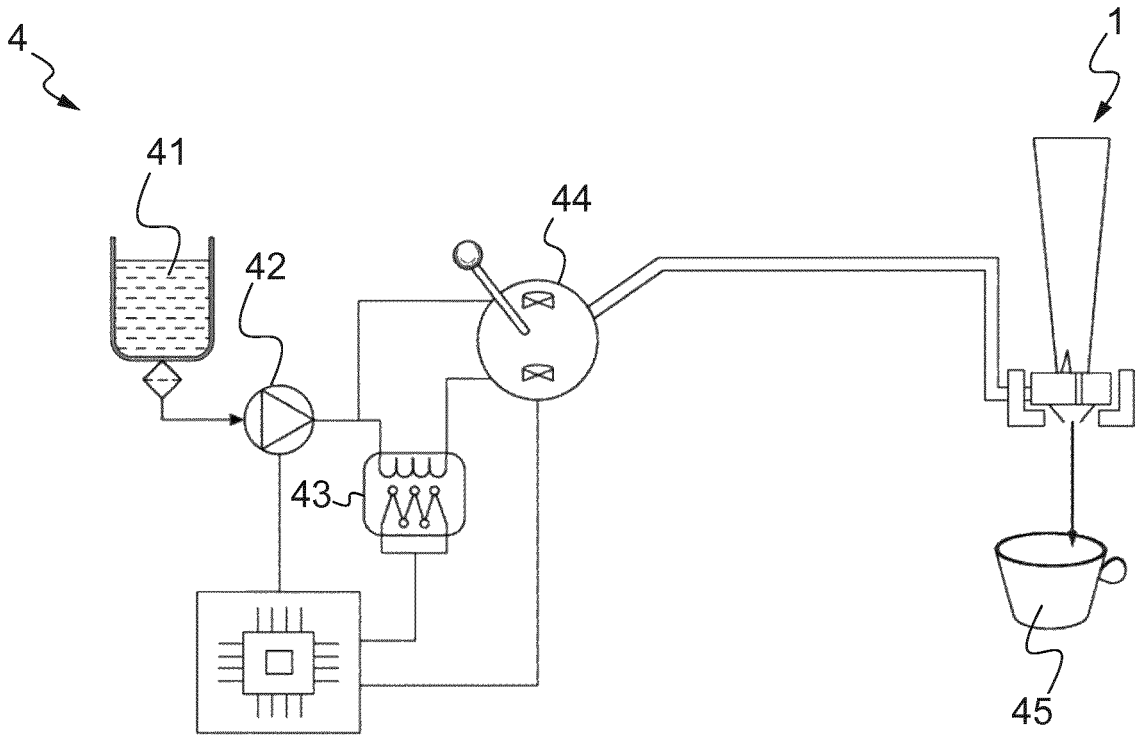
FIG. 6 illustrates a machine for the preparation of a beverage with a pack according to the invention.

FIG. 6 illustrates a machine 4 for the preparation of a beverage with a pack according to the invention.

The machine 4 comprises at least:

- a supply or reservoir/tank 41;
- a pump 42 for pumping the liquid from the supply;
- a heater 43 for eventually heating the liquid;
- a valve 44 for circulating either cold or hot liquid depending on the type of beverage to prepare; and
- a needle 40 for injecting the liquid in one inlet of the pack, The machine 4 may comprise a device for cutting or tearing the tab of the outlet 11 of the pack. The device for cutting or tearing the tab 31 can be positioned so that the outlet 11 is automatically freed when the pack is introduced in the machine 4 or when the beverage preparation is activated.

Preferably the machine 4 comprises an area for positioning a drinking cup 45 under the outlet 11 of the pack when a beverage is prepared.

The pack can comprise recognition means readable by the beverage preparation machine 4. Such recognition means can be mechanical codes, optical codes, RFID tags, bar codes, magnetic codes. Depending on the type of the food or beverage ingredient contained in the pack, the code provides information for the beverage preparation machine to set beverage preparation parameters automatically. These parameters include for instance the type of liquid to inject in the pack, the temperature, volume and pressure of the injected liquid, as well as any sequence of injecting water in the pack including starts and stops.

Generally, the machine 4 comprises an area for receiving the pack configured for positioning the pack so that the outlet 11 is positioned at the bottom of the pack (jaws for maintaining the tab in an upright position). The plane wall 20 is vertically oriented during beverage production.

In the illustrated embodiment in FIGS. 1 to 5, the plane wall 20 comprises two ribs 202. In other words, the pack 1 comprises two possible injection areas 204. The pack 1 can thus be, for example pierced at one or the other or both piercing areas at the outer face 200 of the plane wall 20. The injection areas 204 are disposed in the bottom of the pack 1 above the outlet 11. In this case, the machine can have two needles to enable the injection of the liquid in either one or both of the injection areas 204.

The two ribs 202 are symmetrically formed in the plane wall 20 with respect to the outlet 11. The two injection areas are thus symmetrical with respect to the outlet 11. This symmetric arrangement confers to the pack 1 the advantage of being reversible. In other words, the user does not need to think about the orientation of the pack 1 when introduced in the machine for making a beverage. Indeed, the pack 1 can be introduced with the cover part 3 or with the shell 2 facing the user. Depending on the orientation of the pack 1 when introduced in the machine, the pack 1 can thus be either pierced at the shell 2 at the outer face 200 of the plane wall 20 as described above. Or the pack 1 be pierced at the cover part 3 at a zone face to one of the injection areas 204. In this latter case where the pack 1 is pierced at the cover part 3, the ribs 202 formed in the plane wall 20 also enable a good piercing of the pack 1 without any deterioration. This is particularly true when the ribs 202 are substantially in contact with the cover part 3 since it stiffens the area of the cover part 3 where the pack 1 is to be pierced.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

The pack can present various external shapes other than rectangular, for example square or round shapes.

The pack can comprise a different number of injection areas and/or different shapes of the ribs. For example, the pack can comprise only one injected area surrounded by one rib disposed in the bottom of the pack above the outlet. The rib can be symmetrically disposed in the pack with respect to a median vertical plane perpendicular to the plane wall. The pack is hence symmetrically formed with respect to said median vertical plane. The so formed pack is also reversible. The pack can thus be vertically introduced in the machine in one orientation or the other and hence be pierced at the cover part or at the shell. The rib may present substantially the same height as the height of the peripheral edge to improve the reversibility.

In yet another example, the rib can be a ring interrupted at two portions or apertures.

The invention claimed is:

1. A pack with an inner volume in which a food or beverage ingredient is stored and in which a beverage is produced when water is introduced inside, the pack comprising:

at least one inlet configured to supply water in the inner volume of the pack; and at least one outlet configured for dispensing the beverage from the inner volume of the pack, the pack comprises a semi-rigid or rigid shell made of a material selected from the group consisting of plastic, thick paper, cardboard, metalized foil, and combinations thereof, the semi-rigid or rigid shell comprising a main plane wall surrounded by a peripheral edge and a cover part sealed on the peripheral edge and an enclosing peripheral sidewall joining the peripheral edge to the main plane wall; the semi-rigid or rigid shell, the enclosing peripheral sidewall, and the cover part defining therebetween the inner volume, wherein the at least one outlet is formed in the enclosing peripheral sidewall of the semi-rigid or rigid shell, and wherein the enclosing peripheral sidewall has an opening defined by an interruption of the enclosing peripheral sidewall of the semi-rigid or rigid shell, two portions of the peripheral edge extending and facing each other on each side of the opening and form the at least one outlet of the pack;

wherein the main plane wall has an outer face and an inner face and includes at least one rib protruding from the inner face of the main plane wall the entirety of the at least one rib is spaced apart from the entirety of the enclosing peripheral sidewall and the at least one rib, having a shape of a ring interrupted in a portion to form an aperture, the aperture partly surrounding an injection area configured to receive a water injection needle of a beverage preparation machine; and wherein an openable tabe is configured to close the at least one outlet, the openable tab extending from the cover part of the pack, wherein the openable tab comprises a first part and a second part, the first part of the openable tab extends parallel to the opening and perpendicularly to a flat part of the cover part when the outlet of the pack is closed, the first part of the openable tab is sealed on the outlet to close the outlet, and the second part extends perpendicularly to the first part to be disposed against an outer face of the enclosing peripheral sidewall of the shell and maintain the openable tab in a closed configuration of the pack.

2. A pack according to claim 1, wherein the at least one inlet is provided in the main plane wall of the shell and includes a piercing area configured to be pierced by a water injection needle of a beverage preparation maching.

3. The pack according to claim 2, wherein the piercing area of the at least one inlet is located at the outer face of the main plane wall opposite to the injection area.

4. The pack according to claim 1, wherein, when the pack is used in a beverage preparation machine, the aperature of the ast least one rib partly surrounding the injection area is interrupted in a portion adapted to face a side of the pack distal the outlet, and the at least one outlet is provided at a bottom of the pack.

5. The pack according to claim 1, wherein the at least one rib projects from the inner face of the main plane wall of the shell towards the cover part.

6. The pack according to claim 5, wherein the at least one rib has a height from the inner face of the main plane wall substantially equal to a height of the peripheral edge of the shell.

7. The pack according to claim 1, wherein the at least one rib comprises two ribs protruding from the inner face of the main plane wall and partly surrounding two injection areas, the two injection areas being symmetrically disposed in the main plane wall of the shell with respect to the one outlet and the entirety of the two ribs are spaced apart from the entirety of the enclosing peripheral sidewall.

8. The pack according to claim 7, wherein each rib of the two ribs protruding from the inner face of the main plane wall forms a corresponding recess at the outer face of the main plane wall.

9. The pack according to claim 1, wherein the shell is formed by a thermoforming process or a plastic injection process, the at least one inlet and the at least one outlet of the pack being co-formed with the shell.

10. The pack according to claim 1, wherein the peripheral edge of the shell comprises a wing extending substantially perpendicularly to the peripheral edge, the cover part being sealed on the wing.

11. The pack according to claim 1, wherein the cover part is a flexible membrane or a rigid or semi-rigid wall.

12. The pack according to claim 1, wherein, when the pack is used in a beverage preparation machine, the at least one outlet is provided at a bottom of the pack, and a width of the main plane wall narrows at the bottom of the pack.

13. The pack according to claim 12, wherein the enclosing sidewall peripheral includes two lateral sides that form a tip at the bottom of the pack, the tip forming a passage enabling the beverage to flow through the at least one outlet.

14. The pack according to claim 1, wherein the at least one rib protruding from the inner face of the main plane wall forms a corresponding recess at the outer face of the main plane wall.

* * * * *